United States Patent [19]

Richards

[11] Patent Number: 4,938,456

[45] Date of Patent: Jul. 3, 1990

[54] METALLURGICAL PANEL STRUCTURE

[76] Inventor: Raymond E. Richards, 36227 Ridge Rd., Willoughby, Ohio 44094

[21] Appl. No.: 282,608

[22] Filed: Dec. 12, 1988

[51] Int. Cl.[5] ..... F27D 9/00

[52] U.S. Cl. ..... 266/194; 266/193

[58] Field of Search ..... 266/193, 194; 432/238; 122/6 A, 6 B; 373/76

[56] References Cited

U.S. PATENT DOCUMENTS 4,453,253 6/1984 Lauria et al. ..... 432/238

FOREIGN PATENT DOCUMENTS 2445942 9/1980 France ..... 432/238

*Primary Examiner*—Scott Kastler

*Attorney, Agent, or Firm*—Watts, Hoffmann, Fisher & Heinke Co.

[57] ABSTRACT

A metallurgical cooling panel comprising an outer plate member providing a pari of generally flat cold face surface portions of tangertial construction for plug welding attachment to the peaks of a corrugated inner plate member, an inner plate member being formed to provide a series of laterally spaced corrugations defining peaks and grooves, said peaks and grooves defining elongated cooling medium therethrough, and said peaks being in contact with the confronting cold face surface portions of said inner plate member, a plurality of retention elements secured to the exposed surface of the hot face of the panel, said retention elements extending beyond the exterior apices of the inner plate corrugations, and plug welds securing said contacting surfaces together to provide a finished metallurgical cooling panel.

11 Claims, 5 Drawing Sheets

METALLURGICAL PANEL STRUCTURE

TECHNICAL FIELD

The present invention relates to metallurgical apparatus and more particularly relates to a new and improved construction for a cooling panel system of the type for use in metallurgical furnaces, such as electric arc furnaces or the like.

The invention provides a metallurgical cooling panel that incorporates a corrugated hot face design which defines a plurality of parallel cooling fluid (i.e. water) chambers formed by the valleys of the corrugations so as to present a generally seamless hot face surface which is cooled on the cold face side thereof. In the invention, the outer exposed surfaces of the panel corrugations may be provided with retention elements to facilitate the build-up of refractory (i.e. slag or the like) so that the panel system acts to retain greater heat in the furnace. Preferably, in the invention the panel corrugations extend in a vertical direction with the retainer elements extending horizontally thereof but, in the alternative, the panel corrugations may extend horizontally to accommodate the contour of the furnace shell. In such a case, the retainer elements which provide an "anchor" for refractory build-up may extend horizontally and parallel to the panel corrugations, as desired.

PRIOR ART

The present invention constitutes an improvement over prior cooling panel constructions of the type utilized, for example, in applicant's prior U.S. Pat. No. 4,458,351. The present invention relates to a metallurgical cooling panel, such as for an electric arc furnace, and hence, differs structurally and functionally from the water-cooled exhaust collecting hood constructions as identified in applicants' prior U.S. Pat. Nos. 3,445,101 and 3,661,372 for basic oxygen type steel making furnaces.

Other prior United States patents which relate to various constructions of metallurgical cooling panels include:

| | |
|---|---|
| 2,660,155 | 4,206,312 |
| 2,671,658 | 4,207,060 |
| 3,034,776 | 4,241,232 |
| 3,314,668 | 4,266,758 |
| 3,843,106 | 4,267,216 |
| 3,963,223 | 4,351,055 |
| 4,066,063 | 4,455,017 |

BACKGROUND OF THE INVENTION

From the above identified prior patents, it will be seen that various arrangements for metallurgical cooling panel constructions have been utilized to improve the efficiency of the metallurgical cooling system and hence, attempt to prolong the life of the metallurgical heating furnace. In general, one type of water cooled panel includes the cast metal or solid metal panel type and another type relates to a fabricated panel construction commonly referred to as a water-box. Typically, the water-boxes are fabricated with cooling water inlet and outlet ports which enable cooling water to flow through a selective predetermined path formed in the box for cooling purposes. In some instances, the water-box type cooling panels have been provided with various exterior retention designs to enhance the refractory or slag build-up on the "hot face" of the cooling panel to retain the heat within the furnace. For example, staggered tubes are disclosed in U.S. Pat. No. 4,455,017, fins are disclosed in U.S. Pat. No. 4,351,055, anchors are disclosed in U.S. Pat. No. 4,241,232 and studs are disclosed in U.S. Pat. No. 4,206,312.

In applicant's prior U.S. Pat. No. 3,445,101, a fume hood cooling panel for a basic oxygen steel making furnace is disclosed which utilizes corrugations and in conjunction with fins for dividing the main channel between the cold face and hot face into a number of sub-channels. Similarly, prior U.S. Pat. No. 3,661,372 discloses a fume hood for a basic oxygen furnace which utilizes an undulating front plate in conjunction with a flat back plate and with vane divider bars or plates that are welded to the front and back plates to form internal fluid flow channels within the panel. Accordingly, such prior designs do not disclose a hot-face panel construction wherein the hot face and cold face join and hence, contact on the cold face plate to provide channels for transmitting of a cooling media.

Accordingly, the present invention provides various advantages and efficiencies which are not present in prior cooling panel designs particularly for electric arc furnace applications. Specifically, by the forementioned hot and cold face contact via the corrugations, the interior welds are protected from temperature fluctuations thereby to minimize distortion and/or shrinkage of the panel. Unlike the prior fume hood designs, the improved design of the present invention provides cooling water channels which eliminates the need for special baffles, fins, dividers, vanes and the like and hence, provides a substantial cost savings. Accordingly, the cold-side flat plate is tangentially formed from the center line of the panel so as to provide a structure which can accommodate any curvature of the furnace shell. In the invention, the panel corrugations are made of a heavy gauge steel while the cold side flat plate is plug welded to the corrugated hot face panel so as to give a rigid construction with the welds protected from the high furnace temperatures, as aforesaid.

Also, in the invention the relatively deep vertical grooves formed in the hot face panel by the corrugated design in combination with the retention elements maximize the build-up of refractory (i.e. slag and/or gunning material) on the hot face surface. It has been found that the vertical corrugations act to resist panel warpage, cyclic surface expansion, and impact damage from heavy scrap charges. With the corrugations on the hot face surface, it is believed that there occurs a local plate expansion within the individual loop segments (between plugs and contact to the cold face), rather than a total hot face expansion. Still further, this construction and arrangement provides a great number of possibilities for access hole sizes and locations for furnace entry of lances, probes, oxy fuel burners and the like.

Other advantages and objects of the present invention will become apparent as the following description proceeds when taken in conjunction with the specification and drawings.

DESCRIPTION OF PREFERRED EMBODIMENT

Figure 1:
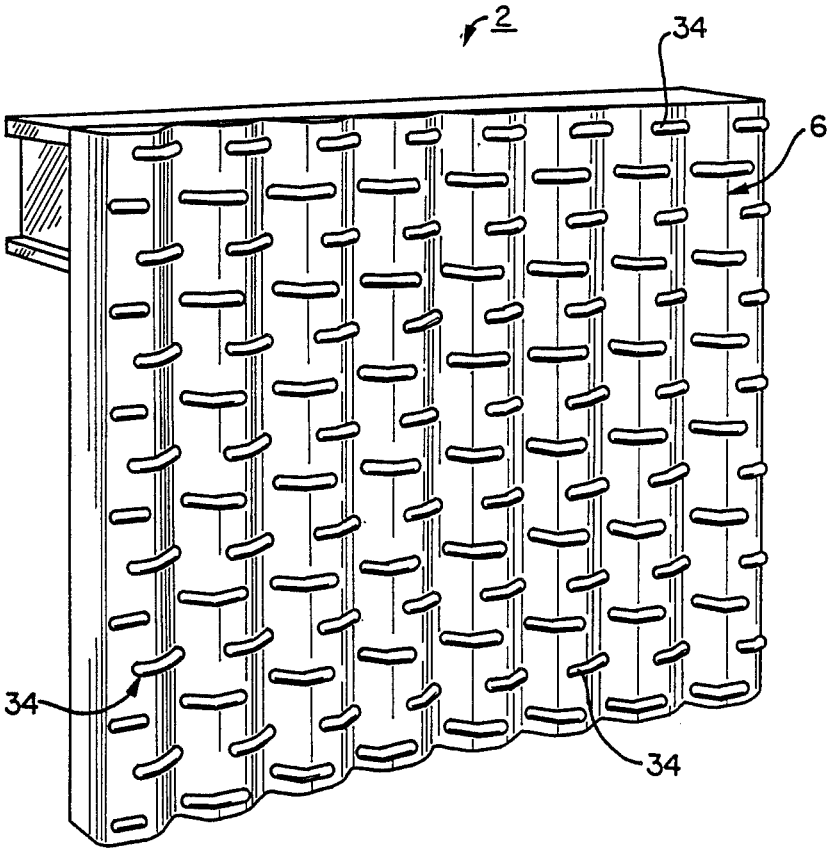
FIG. 1 is a perspective view of the metallurgical panel structure made in accordance with the present invention.
Figure 2:
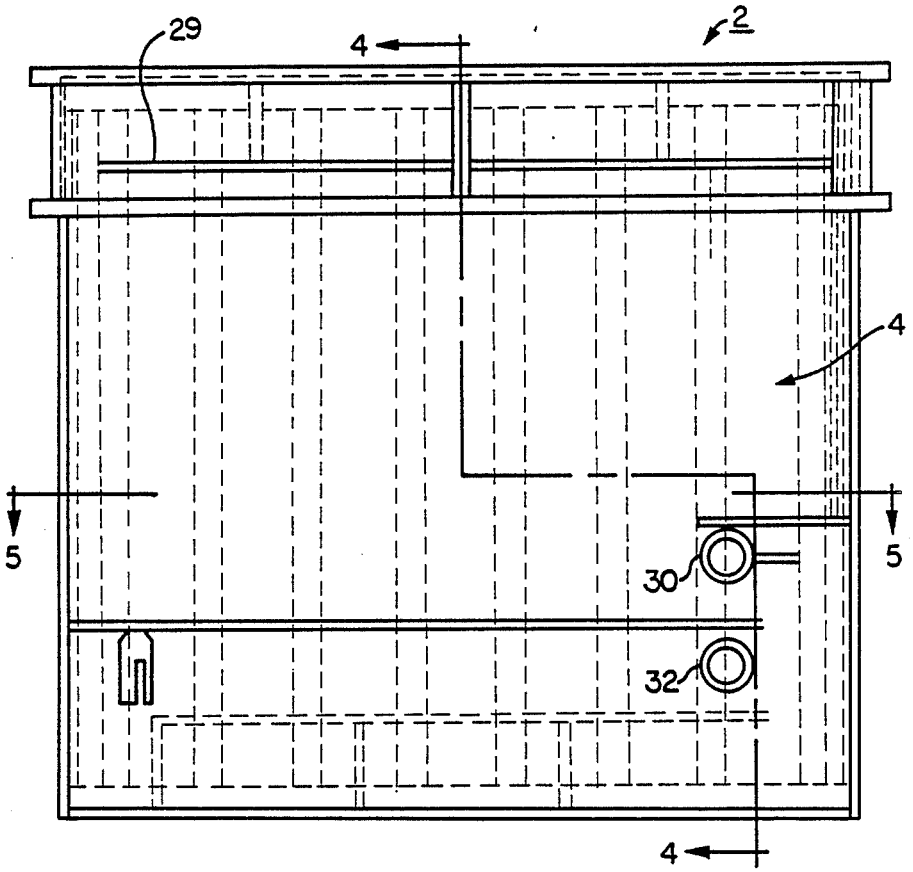
FIG. 2 is a front elevational view of the metallurgical panel structure of FIG. 1.
Figure 3:
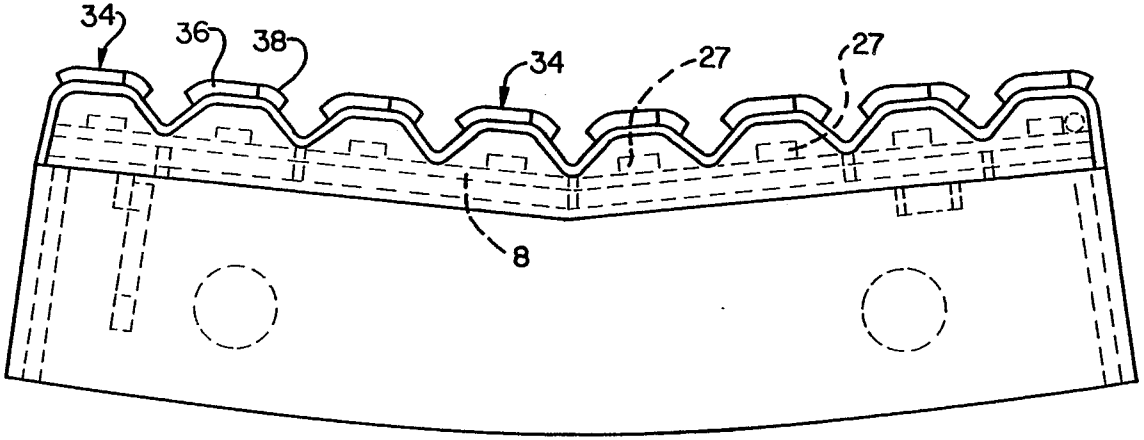
FIG. 3 is a top plan view of the metallurgical panel structure illustrated in FIG. 2.
Figure 4:
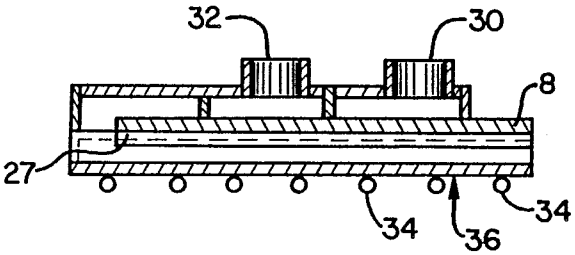
FIG. 4 is a fragmentary, section view taken along the line 4—4 of FIG. 2.

Referring again to drawings and in particular to FIGS. 1 and 4 thereof, there is illustrated the metallurgical panel structure, designated generally at 2 of the invention. The panel structure is of the type for use with a metallurgical furnace, such as an electric arc furnace, as disclosed in applicant's U.S. Pat. No. 4,458,351. Also, it will be recognized that the panel structure of the present invention can be utilized in water-cooled hopper bottom elbows and the like.

In accordance with this form of the invention, a series of metallurgical panels will be mounted within the metallurgical furnace shelf (not shown) to provide a cylindrical configuration sized to accommodate the curvature of the furnace shelf. In the embodiments illustrated, the panel structures are of a substantially identical construction such that like reference numerals will refer to like component parts throughout.

Figure 5:
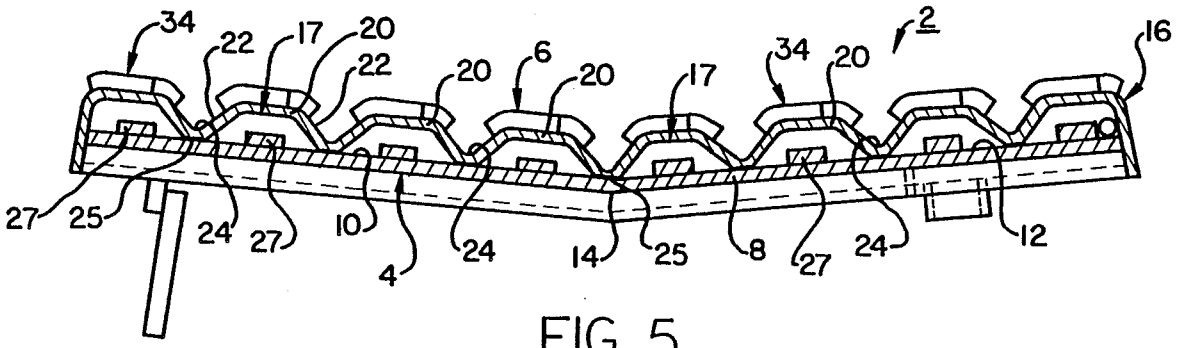
FIG. 5 is a vertical section view taken along the line 5—5 of FIG. 2.
Figure 5A:
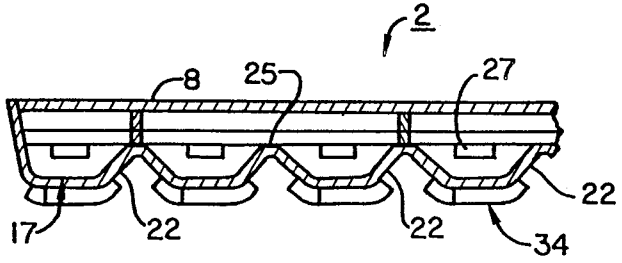
FIG. 5A is a fragmentary vertical section view of the portion of the panel illustrated in FIG. 5.

Referring to FIG. 5, the panel structure 2 has a cold face side, as at 4, and a hot face side, as at 6, and is of a polygonal (i.e. rectangular) configuration in a front elevation view. In the invention, each panel structure includes a unitary, relatively thick cold face plate which has a tangential construction. That is, the plate member 8 has a pair of generally flat cold face surfaces 10 and 12 which extend tangentially outwardly (FIG. 4) from the vertical central axis, as at 14, of the plate member. By this tangentially formed construction, a series of panels can be joined in by side-by-side relation to accommodate any furnace shell configuration.

Now in the invention, the hot face surface of the panel structure is defined by a hot face member, as at 16, which is defined by a series of vertically extending parallel corrugations 17 which extend across the transverse width of the panel. As employed herein, the term "corrugation" or "corrugations" refers to a structure defined by alternating grooves and peaks which are, generally, linear in widthwise dimension. As an example, in a preferred form of invention the corrugations have a truncated triangular configuration, in cross-section, defined by a generally accurate or flat apex portion 20 from which extends a pair of inclined side surface portions 22 with such side surface portions extending divergently outwardly away from the apex portion 20. The inclined side portions 22, in turn, merge into relatively deep acuate grooves, as at 24, which define the peaks so as to define the alternating corrugations shown.

Preferably, the cold face member 8 is formed of a relatively thick unitary construction which may be formed or rolled, as desired. Accordingly, it will be seen that the lowermost end of the grooves 24 contact the confronting surface of the plate member 8 and is secured thereto by suitable plug welds 25. Also, there is achieved by the corrugations increased strength, enabling the panel to withstand the buckling and other strain to which the panel is exposed. The corrugations provide channels to enable the flow of a cooling media (i.e. water) for retaining the heat within the furnace. For example, the depth or thickness of the channels between the two faces will vary depending upon whether it is desirable to have high or low flow velocity through the channels. The number of corrugations determines the number of channels for the cooling medium.

In the invention, elongated baffle plates, as at 27, may be welded to the plate member 8 and extend the vertical height of the panel and have a flat thickness corresponding generally to that of the corrugation thickness. The baffle members act to control fluid flow and give strength to the panel in a vertical direction.

In each end of the panel there may be provided a header or manifold 29 (FIG. 1) adapted to deliver water into or out of the respective channels formed between the corrugations, as disclosed in applicant's U.S. Pat. No. 4,538,351. Accordingly, the cold face is provided with suitable inlet and outlet ports, as at 30 and 32 (FIG. 4), for introducing cooling medium into the system.

Figure 6:
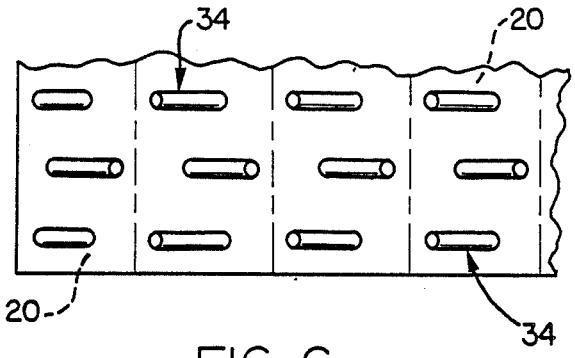
FIG. 6 is a fragmentary, top plan view illustrating the pattern of the retaining elements on the hot face of the panel structure in accordance with the invention.
Figure 6A:
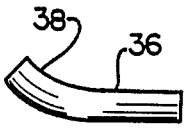
FIG. 6A is an enlarged elevation view of one of the retainer elements removed from the assembly of FIG. 6.

Now in the invention, the respective apex surfaces 20 of the corrugations 16 are provided with a series of retainer elements 34. In a preferred form, the retainer elements 34 include solid bars of a cylindrical construction having a linear portion 36 (FIG. 6A) and a curved portion 38 with the linear portion 36 corresponding to the generally flat or linear surface of the apex portion 20. The curved portion 38 corresponds to the rounded corner 40 where the apex portion 20 merges into the sidewalls 22 of the corrugation. The retaining elements 34 are preferably disposed in an alternating pattern (FIG. 6) such that the curved end portions 38 of adjacent rows are disposed at the opposite ends thereof. Also, shortened linear solid rods of cylindrical construction are used on the side surfaces of the outermost corrugations to complete the alternating pattern. In this arrangement, the retainer elements act to build-up a relatively thick wall of refractory material, as at R, so as to retain a greater amount of heat in the furnace. The hot face corrugated surface in combination with the horizontally disposed retainer elements act to provide an "anchor" and grid-like construction for the retention of refractory material, such as slag and/or gunning material, for example.

Accordingly, in the invention it will be recognized that the corrugations may be fabricated so as to extend horizontally rather than in a vertical direction. In such case, the retainer elements may extend horizontally and parallel with the corrugations or vertically and at right angles to the corrugations to enhance the refractory build-up, as desired.

While the preferred embodiments of this invention have been described, it will be understood that other modifications can be made within the spirit and scope of the invention and it is not intended to limit the invention to the exact details with the invention being defined in the following claims.

I claim:

1. In a metallurgical cooling panel, the improvement comprising an outer plate member providing a pair of generally flat cold face surface portions of tangential construction for plug welding attachment to the peaks of a corrugated inner plate member, an inner plate member providing a hot face surface, said inner plate member being formed to provide a series of laterally spaced corrugations defining peaks and grooves, said peaks and grooves defining elongated cooling fluid channels for transmitting a cooling medium therethrough, and said peaks being in contact with the confronting cold face surface portions of said inner plate member, a plurality of retention elements secured to the exposed surface of each of the corrugations to build up refractory material on the hot face of the panel, said retention elements extending beyond the exterior apices of the inner plate corrugations, and plug welds securing said contacting surfaces together to provide a finished metallurgical cooling panel.

2. A metallurgical panel structure in accordance with claim 1, wherein said elongated corrugations extend vertically throughout the hot face surface of said panel.

3. A metallurgical panel structure in accordance with claim 1, wherein said elongated corrugations extend in a horizontal direction throughout the hot face surface of said panel.

4. A metallurgical panel structure in accordance with claim 1, wherein said corrugations have a generally polygonal configuration, in cross-section, defined by an apex surface portion and a pair of inclined side surface portions.

5. A metallurgical panel structure in accordance with claim 4, wherein said panel corrugations are of a generally truncated configuration in cross-section.

6. A metallurgical panel structure in accordance with claim 1, wherein said elongated panel corrugations extend in a vertical direction throughout the surface of said hot face, and a plurality of retention elements are secured to the exposed surface of each of said corrugations to build-up refractory material on the hot face surface of said panel.

7. A metallurgical panel structure in accordance with claim 6, wherein said retention elements extend generally horizontally relative to said corrugations.

8. The metallurgical panel structure in accordance with claim 6, wherein the retainer elements include solid bar elements which are disposed in alternating, off-set generally parallel rows on the hot face surface.

9. The metallurgical panel structure in accordance with claim 1 wherein said cold face member has a tangential configuration defined by generally flat surface portions which extend downwardly and inwardly away from the vertical center line of said panel.

10. A metallurgical panel structure in accordance with claim 1, including a manifold header extending transversely across one end of said panel structure and communicating with said fluid channels to transmit cooling media through and from each of said channels.

11. The metallurgical panel structure in accordance with claim 1 wherein both the inner and the outer plate members are of heavy steel.

* * * * *